United States Patent [19]

Van Alphen et al.

[11] 4,027,219

[45] May 31, 1977

[54] DEVICE FOR DISPLAYING COLOR TELEVISION IMAGES

[75] Inventors: Willem Meijndert Van Alphen; Piet Gerard Joseph Barten; Johannes Van Den Boogert; Joris Adelbert Maria Nieuwendijk; Jan Gerritsen; Adrianus Hubertus Kantelberg, all of Eindhoven, Netherlands

[73] Assignee: U.S. Philips Corporation, New York, N.Y.

[22] Filed: Nov. 5, 1975

[21] Appl. No.: 628,908

[30] Foreign Application Priority Data

Nov. 14, 1974 Netherlands ..... 7414845

[52] U.S. Cl. ..... 315/368; 315/13 C; 335/213

[51] Int. Cl.[2] ..... H01J 29/70; H01J 29/76

[58] Field of Search ..... 315/13 C, 368; 335/213

[56] References Cited

UNITED STATES PATENTS

| | | | |
|---|---|---|---|
| 2,165,803 | 7/1939 | Maloff | 335/213 |
| 2,598,303 | 5/1952 | Reinhard | 315/370 |
| 3,424,942 | 1/1969 | Barbin | 315/368 |

*Primary Examiner*—Maynard R. Wilbur
*Assistant Examiner*—T. M. Blum
*Attorney, Agent, or Firm*—Frank R. Trifari; Henry I. Steckler

[57] ABSTRACT

A color television display tube comprising at least eight correction coils, arranged in one plane about the tube neck, for controlling the static convergence and possibly other aspects such as color purity.

11 Claims, 10 Drawing Figures

DEVICE FOR DISPLAYING COLOR TELEVISION IMAGES

The invention relates to a display tube for displaying colour television images, comprising a neck portion accommodating means for generating three electron beams which are situated approximately in one plane, correction coils being arranged about the neck portion which are connected to variable direct current sources for the displacement of the outer beams with respect to the central beam.

U.S. Pat. No. 3,725,831 describes a device of this kind wherein four consecutively arranged rings whereon each time four or six toroidally wounds coils are present are required to enable adjustment of any desired displacement of the outer beams. Twenty individually wound toroidal coils are thus required in total. A construction of this kind is expensive, because it is comparatively difficult to wind toroidal coils on a ring. Moreover, the rings with the coils wounds thereon are rather thick, so that the set of four rings occupies substantial space in the axial direction; this is contrary to the desire for an ever shorter length of the tube neck and the components arranged thereon, whilst, moreover, the various corrections of the outer beams are effected at locations which differ from each other in the axial direction, which is liable to have an adverse effect.

The invention has for its object to realize a construction wherein the said drawbacks are avoided. To this end, the device according to the invention is characterized in that at least eight coils are arranged about the neck portion of the tube such that their axes are situated in one plane, the coils being connected in circuits including variable direct current sources such that at least eight magnetic poles which are distributed about the tube neck and which are situated in one plane are obtained, the strength and the polarity of the said poles being variable, the arrangement being such that the extent of the displacement of each of the outer beams can be adjusted in any direction.

The invention will be described in detail herein-after with reference to the drawing.

Figure 1:
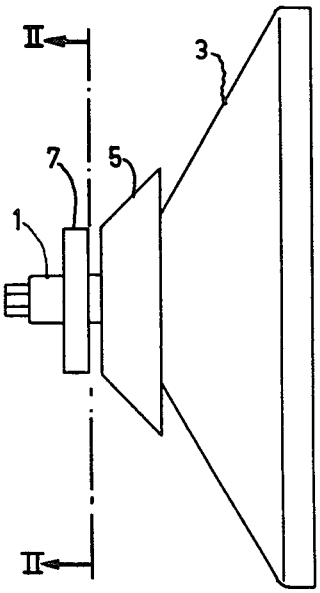
FIG. 1 shows a colour television display tube according to the invention.
Figure 2:
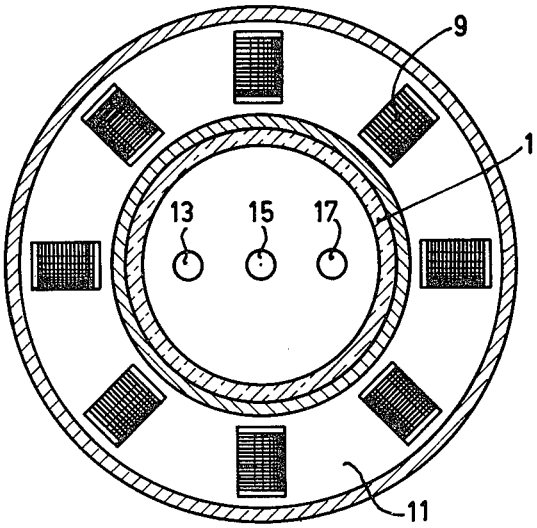
FIG. 2 shows a first embodiment of the construction of a correction device for the display tube shown in FIG. 1, FIG. 3*a* and *b* show a second embodiment of such a construction.

The colour television display tube which is diagrammatically shown in FIG. 1 comprises a cylindrical neck portion 1 accommodating electron guns (not visible in FIG. 1) for generating three electron beams which are situated approximately in one plane, and a flared portion 3. At the area of the transition between the two portions, a deflection unit 5 is arranged, followed by a correction device 7. As is shown in FIG. 2, this correction device can comprise a number of solenoid coils 9 which are radially directed towards the axis of the tube neck 1 and which are arranged in a holder 11 mounted on the neck such that their axes are situated in one plane. When the coils 9 are connected to one or more direct current sources, inside the tube neck 1 static magnetic fields are generated which cause a displacement of the three electron beams 13, 15, 17. By constructing the current sources to be variable, this displacement can be influenced as regards extent and direction. It was found that, using eight coils like in the embodiment shown in FIG. 2, any desired displacement of the beams 13, 15, 17 can be realized. It is thus possible to compensate for manufacturing tolerances which could give rise to errors in the convergence and colour purity.

When current is conducted through the coils, each of the coils 9 has a magnetic north pole on one end and a magnetic south pole on the other end, so that a ring of eight magnetic poles which are grouped about the tube neck 1 and which are situated in one plane is obtained on the inner edge of the holder 11. If desired, each of the coils 9 can be provided with a ferromagnetic core which may be interconnected by way of a yoke ring enclosing the coils (not shown).

Figure 3A:
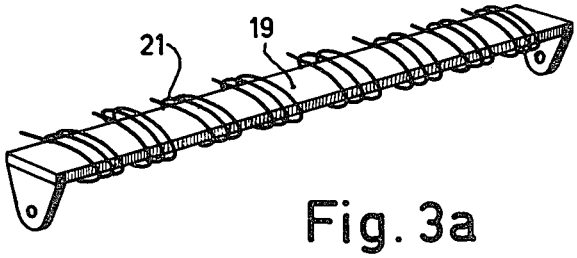
Figure 3B:
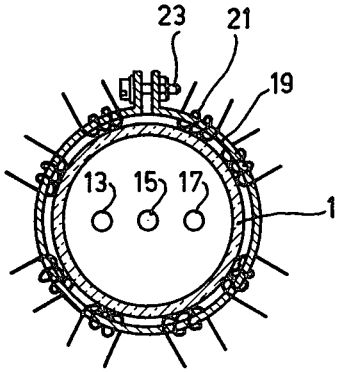

The same effect can also be obtained using toroidal coils instead of solenoids as shown in FIG. 2. Because the winding of toroidal coils on a closed ring is rather expensive, use is preferably made, as is shown in FIG. 3, of an elongate flexible support 19 whereon coils 21 are wound (FIG. 3*a*). Subsequently, the support 19 is bent, as is shown in FIG. 3*b*, about the tube neck 1 and secured by means of a bolt 23. If each two adjacently arranged coils are excited in the opposite sense, eight magnetic poles which are situated in one plane are again obtained. In this case the support 19 can also be made of ferromagnetic material or, if desired, it can contain ferromagnetic material only at the area of the coils 21.

Each of the coils 9 and 21 described with reference to the FIGS. 2 and 3 can consist of one or more wires, and their number of turns and their winding directions may be the same or different. As a result, in conjunction with suitable circuits, any desired method of displacement of the beams 13, 15, 17 can be realized, such as a displacement of all three beams simultaneously, displacement of the two outer beams with respect to the central beam, i.e. in mutually the same or mutually opposite directions, as desired, displacement of each of the outer beams individually in any desired direction. A number of relevant examples are shown in the FIGS. 4 to 7. In these examples use is always made of radially directed coils, for example, having the construction shown in FIG. 2, but it will be obvious that the same effects can be achieved using toroidal coils as shown in FIG. 3.

Figure 4:
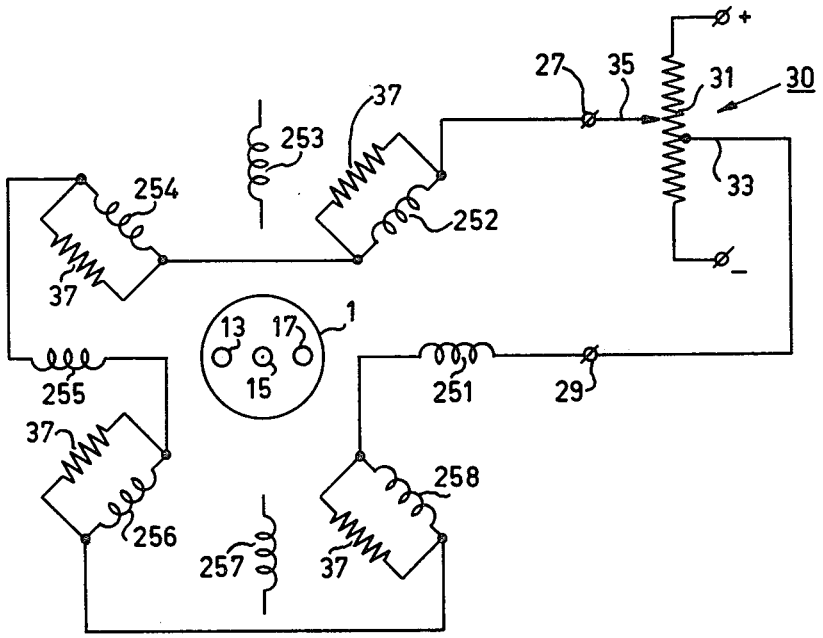
FIGS. 4 to 7*a*–7*c* show various embodiments of circuits of a correction device for the display tube shown in FIG. 1.

FIG. 4 shows an embodiment including eight coils 251 to 258 which are uniformly distributed in a ring about the tube neck 1, each coil having the same winding direction and the same number of turns. The coils are connected such that inside the tube neck 1 a magnetic six-pole field is generated, an axis thereof being situated in the plane of the three electron beams 13, 15, 17 when current is applied to the circuit via connection terminals 27, 29. This current can be derived from a variable direct current generator 30 which comprises, for example, a resistor 31 having a fixed central tapping 33 and a sliding contact 35, so that the current can be varied from a maximum value in one direction, via zero, to a maximum value in the opposite direction. In theory and in practice it can be demonstrated that the described six-pole field arises when the number of ampere-turns of the coils 251 to 258 successively equals $N, -\frac{1}{2}N\sqrt{2}, O, \frac{1}{2}N\sqrt{2}, -N, \frac{1}{2}N\sqrt{2}, O, -\frac{1}{2}N\sqrt{2},$ minus sign indicating that the current passes through the relevant coil in a direction opposing the current direction in the coil 251.

It follows from the foregoing that the coils 253 and 257 are not connected, and that the absolute value of the current in the coils 252, 254, 256 and 258 relates to the current in the coils 251 and 252 as 1: $\sqrt{2}$. To this end, the coils 252, 254, 256 and 258 are provided with parallel resistors 37 having a value $$R = R_L \cdot \frac{1}{\sqrt{2-1}},$$

$R_L$ being the resistance of a coil.

As is known, for example, from the said U.S. Pat. No. 3,725,831, a magnetic six-pole field having an axis situated in the plane of the three beams 13, 15, 17, i.e. horizontal, causes, an equal displacement of the two outer beams 13, 17 in a direction perpendicular to the plane of the beams, whilst the central beam 15 is not influenced. When the position of the sliding contact 35 is changed, an arbitrary simultaneous displacement of the two beams 13, 17 in the upwards or downwards direction can thus be adjusted.

Generally, more than just this one adjustment possibility is desired, this can be achieved by means of additional multi-pole magnetic fields. For example, a six-pole field having an axis perpendicular to the pulse of the three beams (i.e. vertical) causes a simultaneous displacement of the outer beams 13, 17 to the left or to the right. A four-pole field having an axis in the horizontal direction causes a vertical displacement of the outer beams 13, 17 in opposite directions, and a four-pole field having an axis which encloses an angle of 45° with the horizontal, i.e. according to the coils 252 to 256, causes a similar displacement in the horizontal direction. A two-pole field having an axis in the vertical direction causes a displacement of all three beams in the horizontal direction and can serve for the adjustment of the colour purity, whilst a two-pole field having an axis in the horizontal direction can be used for correcting given frame errors (see U.S. Pat. No. 3,973,199). These magnetic fields can all be realized using circuits of the type shown in FIG. 4. Table I shows the number of ampere-turns per coil for each of the said fields.

TABLE I.

| kind of field and axis direction / coil number | 2-pole hor. | 2-pole vert. | 4-pole hor. | 4-pole 45° | 6-pole hor. | 6-pole vert. |
|---|---|---|---|---|---|---|
| 251 | N | O | N | O | N | O |
| 252 | $\frac{1}{2}N\sqrt{2}$ | $-\frac{1}{2}N\sqrt{2}$ | O | N | $-\frac{1}{2}N\sqrt{2}$ | $\frac{1}{2}N\sqrt{2}$ |
| 253 | O | −N | −N | O | O | −N |
| 254 | $-\frac{1}{2}N\sqrt{2}$ | $-\frac{1}{1}N\sqrt{2}$ | O | −N | $\frac{1}{2}N\sqrt{2}$ | $\frac{1}{2}N\sqrt{2}$ |
| 255 | −N | O | N | O | −N | O |
| 256 | $-\frac{1}{2}N\sqrt{2}$ | $\frac{1}{2}N\sqrt{2}$ | O | N | $\frac{1}{2}N\sqrt{2}$ | $-\frac{1}{2}N\sqrt{2}$ |
| 257 | O | N | −N | O | O | N |
| 258 | $\frac{1}{2}N\sqrt{2}$ | $\frac{1}{2}N\sqrt{2}$ | O | −N | $\frac{1}{2}N\sqrt{2}$ | $-\frac{1}{2}N\sqrt{2}$ |

Table I shows that the six different fields can be adjusted independent of each other by winding each time three coils one over the other at the positions 251, 253, 255 and 257, and each time five coils at the remaining positions. These coils can then be connected in six circuits of the type shown in FIG. 4. Obviously, the number of ampere-turns can also be controlled by a suitable choice of the number of turns per coil instead of by means of the parallel resistors 37. Similarly, coils for which the number of ampere-turns must be negative in accordance with table I can be wound, for example, counter-clockwise, whilst the other coils are wound clockwise, with the result that the current direction will be the same in all coils.

Figure 5:
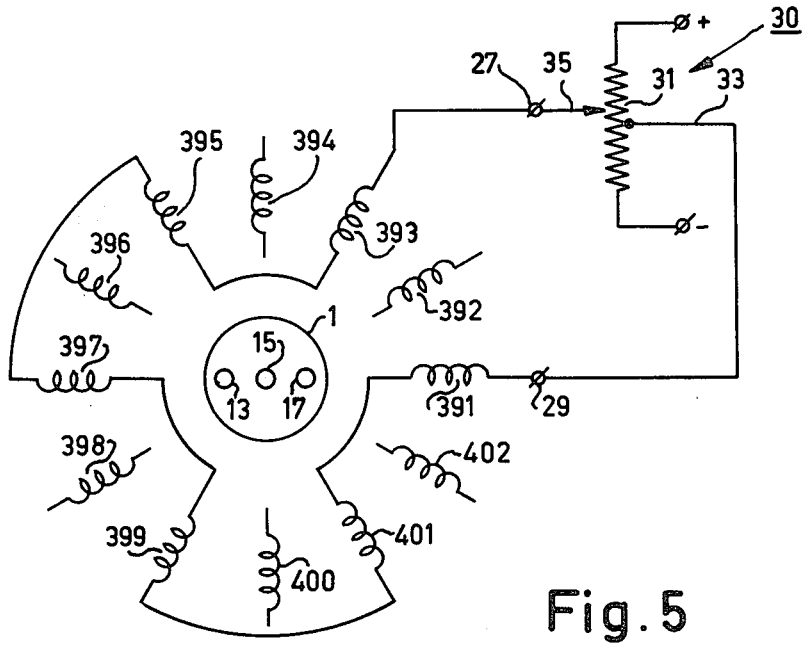
Figure 6:
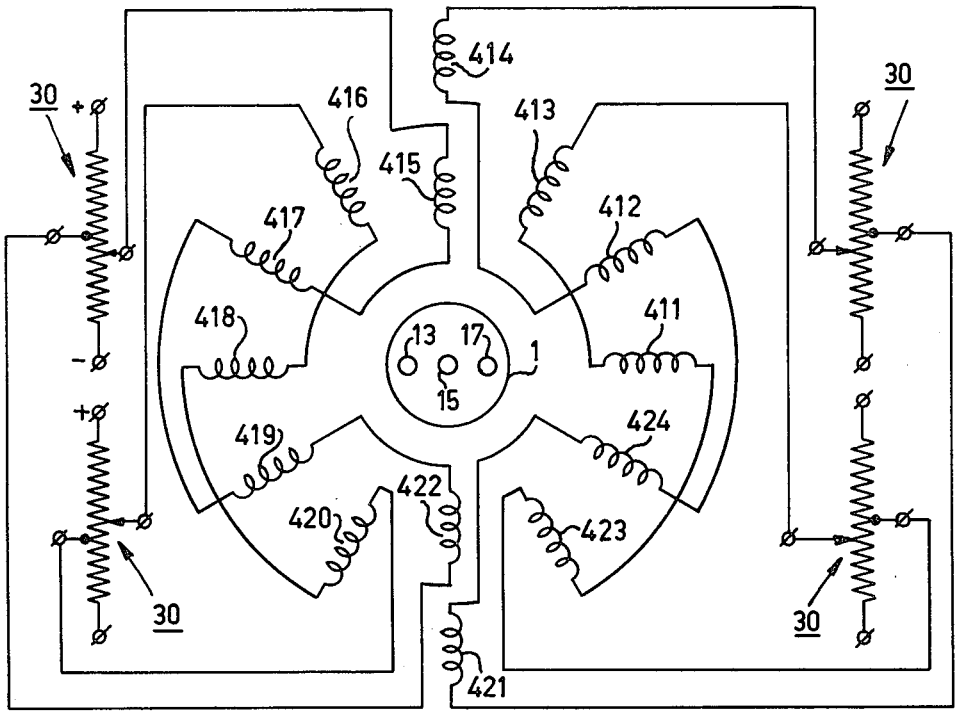

In order to enable any desired displacement of the three electron beams 13, 15, 17 to be realized, eight coils as described above are sufficient, some of the said coils consisting of three and others consisting of five sub-coils which operate independent of each other. The same result, however, can be achieved using twelve coils which are regularly distributed about the tube neck 1, each coil consisting of three identical sub-coils. This is shown in FIG. 5. The power supply is identical to that shown in FIG. 4 and is denoted by the same references. All 12 coils 391 . . . 402 have the same number of turns and conduct the same current, the current direction in some coils, however, opposing that in other coils. The circuit shown in FIG. 5, in which the number of ampere-turns of the coils 391 to 402 equals −N, O, N, O −N, O, N, O, −N, O, N. O, respectively, again produces a variable six-pole field having a horizontal axis, like th circuit shown in FIG. 4. Table II shows how large the number of ampere-turns must be for generating other fields. It appears that it is sufficient to use three identical sub-coils in each position, each time two sub-coils in each position being connected in series for the four-pole field having a horizontal axis in order to achieve 2N ampere-turns at the same current intensity as in the other sub-coils.

TABLE II.

| kind of field and axis direction / coil number | 2-pole hor. | 2-pole vert. | 4-pole hor. | 4-pole 45° | 6-pole hor. | 6-pole vert. |
|---|---|---|---|---|---|---|
| 391 | O | O | −2N | O | −N | O |
| 392 | −N | O | O | −N | O | −N |
| 393 | O | −N | O | −N | N | O |
| 394 | O | O | 2N | O | O | N |
| 395 | O | −N | O | N | −N | O |
| 396 | N | O | O | N | O | −N |
| 397 | O | O | −2N | O | N | O |
| 398 | N | O | O | −N | O | N |
| 399 | O | N | O | −N | −N | O |
| 400 | O | O | 2N | O | O | −N |
| 401 | O | N | O | N | N | O |
| 402 | −N | O | O | N | O | N |

Obviously, the number of ampere turns can also be varied in a different manner, as has already been explained with reference to FIG. 4.

Using the described device, the two outer beams 13, 17 can each time be displaced together with respect to the central beam 15. However, it may be desirable to displace the two outer beams also more or less independent of each other. A device enabling this kind of displacement is diagrammatically shown in FIG. 6. Coils which are denoted by the reference 411 to 424 are arranged at equal distances from each other at twelve positions about the tube neck 1. At two positions, i.e. at the top centre and the bottom centre of the tube neck, each time two coils 414, 415 and 421, 422 are arranged, so that in total fourteen coils are present. The number of turns of the coils 414, 415, 421 and 422 amount to half of those of the other coils. As is shown in the Figure, the coils 414, 412, 424 and 421 are series-connected and are connected to a first variable current source 30, the current direction through the coils 414 and 421 opposing that through the coils 412 and 421.

The coils 414, 412, 424 and 421 together constitute one half of a six-pole having a vertical axis as described with reference to FIG. 5. The other half of the said six-pole is formed by the coils 415, 417, 419 and 422. If the current in the two halves ie equal and such that the current direction in the coils 414 and 415 is the same, a complete six-pole having a vertical axis arises whereby the two outer beams 13, 17 can be displaced in the horizontal direction to the same extent. If the sign of the current direction in the left-hand half is reversed, the currents in the coils 414, 415 and 421, 422 will cancel each other's effect and a (distorted) four-pole field will be produced which enables the beams 13, 17 to be displaced horizontally, but in the opposite direction. In both cases the central beam 15 remains in position. In the case of an arbitrary choice of the direction and intensity of the currents through the two six-pole halves, combinations of the two above cases will arise; then, the central beam 15 will not completely remain in position and no completely independent displacement of the outer beams 13, 17 will occur either, but the displacement of the beam 17 will still be determined mainly by the current in the coils 414, 412, 424 and 421 and that of the beam 13 by the current in the coils 415, 417, 419, 422.

The coils 413, 411, 423 together constitute one half six-pole having a horizontal axis, the other half thereof being formed by the coils 416, 418, 420. Similar to the foregoing description, a vertical displacement of the two outer beams 13, 17 can thus be obtained, the displacement of the beam 17 being mainly determined by the current in the coils 413, 411, 423 and that of the beam 13 by the current in the coils 416, 418, 420, the other two beams then being subject to a slight cross-talk.

It was also found to be possible to construct an embodiment of the device according to the invention wherein the cross-talk in the other two beams is substantially completely eliminated. Moreover, in this embodiment a further drawback which is liable to occur in the described devices in some cases can be mitigated, i.e. the induction of parasitic currents from the deflection unit 5 (see FIG. 1) in the correction device 7. Because these two devices are arranged near to each other on the tube neck 1, it sometimes occurs that the line deflection field, having a frequency of approximately 15 kHz, induces voltages in the coils of the correction device 7.

Figure 7A:
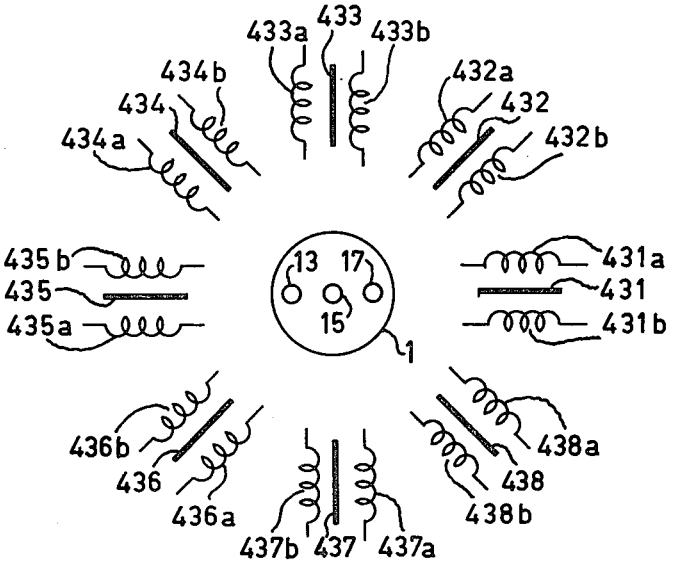
Figure 7B:
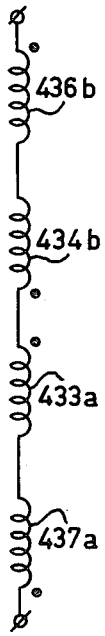
Figure 7C:
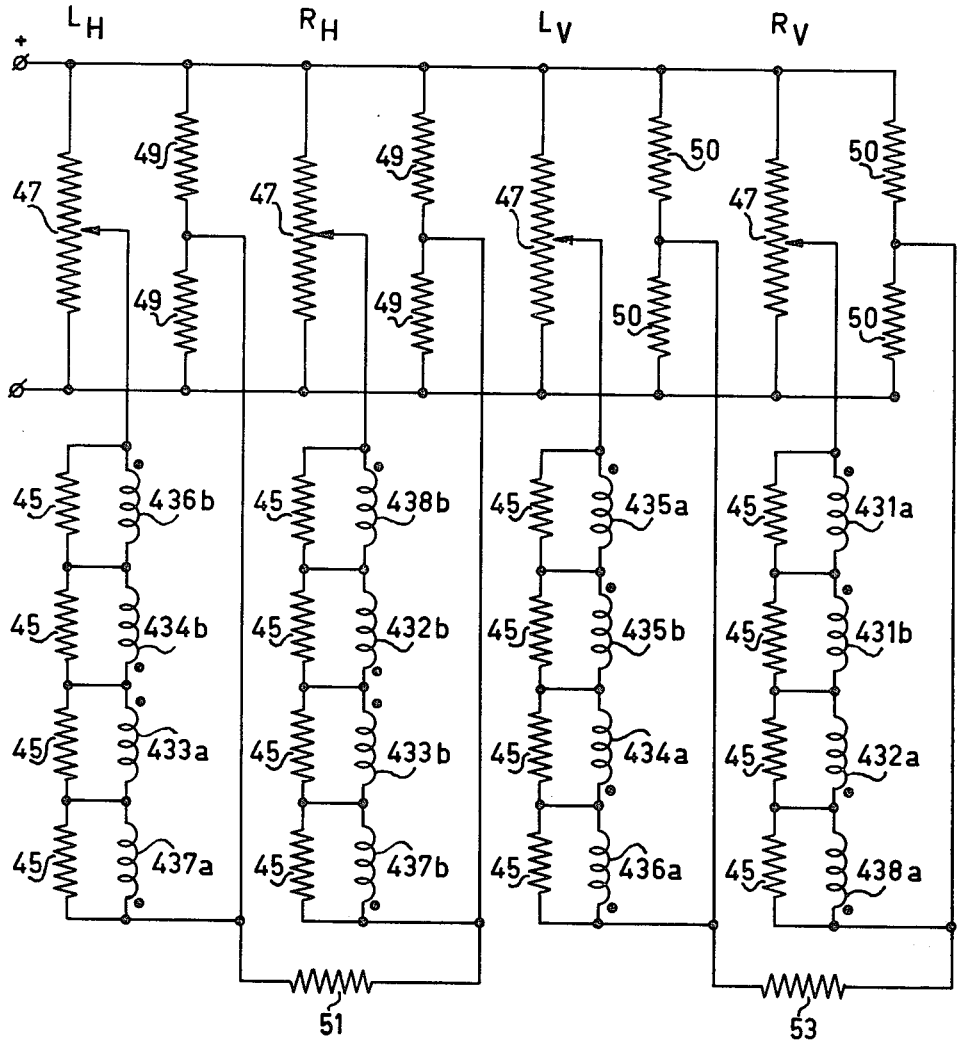

FIGS. 7*a* to 7*c* show an embodiment which enables substantially completely independently control of the position of the outer beams 13, 17 and which, moreover, is highly insusceptible to induction of parasitic currents. The device comprises eight ferrite rods 431 . . . 438 which are regularly distributed in a ring about the tube neck 1, each rod comprising two coils, denoted as 431*a*, 431*b* etc. For the displacement of the left beam 13 in the horizontal direction, the coils 434*b* and 436*b* are excited in an opposite sense, so that the vertically directed magnetic flux arises. The effect on the control beam 15 and the right beam 17 can then be compensated for by exciting the coils 433*a* and 437*a* to a lesser extent and opposite to 434*b* and 436*b*, respectively.

The line deflection field, being vertically directed, induces different voltages in the coils at the different positions, depending on the position. The maximum voltage occurs in the coils 433*a*, *b* and 437*a*, *b*, about 80% thereof occurring in 432*a*, *b*, 434*a*, *b*, 436*a*, *b*, whilst no voltage occurs in 431*a*, *b* and 435*a*, *b*.

FIG. 7 shows how the four coils 434*b*, 436*b*, 433*a* and 437*a* can be connected so as to achieve that the left beam 13 is substantially exclusively displaced in the horizontal direction, and also that the voltages induced the coils cancel each other. To this end, the four coils are connected in series, the end facing the tube neck 1 being each time denoted by a dot (the winding directions of all coils are assumed to be the same). When a direct current flows through the series connection, the coils 436*b* and 434*b* are oppositely excited and the coils 433*a* and 437*a* are excited in an opposite sense with respect to 434*b* and 436*b*, respectively, as can be readily seen from FIG. 7*b*. By constructing the coils 436*b* and 434*b* such that they have more turns than 433*a* and 437*a*, it is achieved that magnetic field generated by 436*b* and 434*b* is stronger than that generated by 433*a* and 437*a;* this is in agreement with the conditions for independent control of the left beam 13. The line-frequency voltages induced in the coils 434*b* and 433*a* are subtracted from each other in the circuit shown in FIG. 7*b*. Because the coil 434*b* must comprise more turns than 433*a* in accordance with the foregoing, the ratio between the number of turns of the two coils can be chosen such that the induced voltages are equal, so that the subtraction results in the value zero. The same is applicable to the coils 436*b* and 437*a*, so that the total voltage induced in the circuit shown in FIG. 7*b* equals zero when the numbers of turns of the coils are suitably chosen. It was found that as distribution of turns which satisfies this condition also enables an independent displacement of the left outer beam 13 in the horizontal direction with a good approximation. Any residual effects on the remaining beams can be eliminated using simple circuits as will be described hereinafter with reference to FIG. 7*c*.

For the displacement of the left outer beam 13 in the vertical direction, the coils 435*a* and *b* are excited. The effect on the other beams is compensated for by exciting the coils 434*a* and 436*a* to a lesser extent and in the opposite direction with respect to 435*a* and *b*. This can be achieved by means of a series connection of the four coils analogous to FIG. 7*b*, the coils 435*a* and *b*, however, being arranged in the same direction and opposite to the other two coils. No line-frequency voltage will be induced in the coils 435*a*, *b*, whilst the voltages induced in the coils 434*a* and 436*a* cancel each other, with the result that the number of turns can then be completely determined by the condition that the displacement of the left beam 13 may not influence the two other beams. Instead of providing the core 435 with two coils 435*a* and *b* in series, it could, of course, also be provided with one coil which would require double the number of turns. However, it was found that the described solution is simpler, because the coils on the cores 431, 433, 435 and 437 can then be identical, like the coils on the cores 432, 434, 436 and 438, so that only two types of coil are required.

For the displacement of the right outer beam 17 the remaining coils are combined in two series circuits in the same manner as described above. The ultimate circuit of all coils is shown in FIG. 7*c*. The extreme left series circuit is the same as that shown in FIG. 7*b* and, consequently, serves for the displacement of the left beam in the horizontal direction as is denoted by $L_H$ above this circuit, Furthermore, the circuits from left to right serve for the displacement of the right beam in the horizontal direction ($R_H$), the left beam in the vertical direction ($L_V$), and the right beam in the vertical direction ($R_V$). A resistor 45 is connected parallel to each of the coils, so as to enable individual suppression of any capacitive line frequency current in each coil. These resistors do not effect the operation of the circuit and can be dispensed with if they are not required.

The currents in the four coil circuits can be adjusted in a conventional manner by means of a circuit comprising four potentiometers 47, each potentiometer having a voltage divider, consisting of two fixed resistors 49 for circuit $L_H$ and $R_H$ and 50 for $L_V$ and $R_V$, connected in parallel thereto. In order to compensate for any residual cross-talk not eliminated by the choice of the number of turns of the coils, the circuits $L_H$ and $R_H$ and the circuits $L_V$ and $R_V$ can be interconnected via resistors 51 and 53, respectively.

In a practical embodiment of the correction device described with reference to the FIGS. 7*a* to *c*, favourable results were obtained using the following values for the components: coils on cores 431, 433, 435, 437 each comprising 2 × 345 turns of wire 0.18 mm, coils on the remaining cores each comprising 2 × 425 turns of wire 0.18 mm; resistance:

| | |
|---|---|
| 45 | 1200 Ω |
| 47 | 250 Ω |
| 49 | 68 Ω |
| 50 | 120 Ω |
| 51 | 33 Ω |
| 53 | 220 Ω |

What is claimed is:

1. A correction circuit for a display tube having a neck portion means for generating three coplanar electron beams, said circuit comprising at least eight static convergence correction coils adapted to be disposed about said neck portion with coplanar axises, and means for adjusting the displacement of the two outer beams in any direction with respect to the center beam and for applying direct current variable in amplitude and polarity to said coils, whereby at least eight variable strength magnetic poles are obtained distributed about the neck in one plane.

2. A circuit as claimed in claim 1, wherein that the coils are solenoids which are arranged in a ring about the tube neck, their axis being directed radially towards the axis of the tube neck (1).

3. A circuit as claimed in claim 1, wherein the coils are toroidal coils and further comprising a common annular support means for mounting said coils about the tube neck, said support comprising a flexible material, the said support being bent to form a ring after the mounting of the coils

4. A circuit as claimed in claim 1, wherein said adjusting and applying means includes means fro providing generation by said coils of at least the following variable magnetic fields in the tube neck, a six-pole field having a horizontal axis, a six-pole field having a vertical axis, a four-pole field having an axis which encloses an angle of 45° with the horizontal.

5. A circuit as claimed in claim 4, wherein said adjusting and applying means includes means for providing generation by said coils of at least the following variable magnetic fields in the tube neck, a six-pole field having a horizontal axis, a six-pole field having a vertical axis, a four-pole field having a horizontal axis, and a four-pole field having an axis which encloses an angle of 45° with the horizontal.

6. A circuit as claimed in claim 5, wherein said adjusting and applying means includes means for providing generation by said coils of at least one variable magnetic two-pole field.

7. A circuit as claimed in claim 4, wherein said adjusting and applying means includes means for providing generation by said coils of at least one variable magnetic two-pole field.

8. A circuit as claimed in claim 7 wherein said adjusting and applying means includes means for providing generation by said coils of a second variable magnetic two pole field, one of said fields having a horizontal axis and one a vertical axis.

9. A circuit as claimed in claim 6 wherein said adjusting and applying means includes means for providing generation by said coils of a second variable magnetic two pole field, one of said fields having a horizontal axis and one a vertical axis.

10. A circuit as claimed in claim 1, wherein at least eight positions which are regularly distributed about the tube neck coils are disposed, said adjusting and applying means comprising four circuits including a first and second circuit means for providing that two vertically directed variable magnetic fields can be generated, each of which influences one of the outer beams substantially stronger than the two other beams, and a third and a fourth circuit means for providing that horizontally directed variable magnetic fields, each of which influences one of the outer beams substantially stronger than the two other beams,

11. A circuit as claimed in claim 1, wherein said adjusting and applying means provides that voltages induced in the said coils by a line deflection system cancel each other.

* * * * *

UNITED STATES PATENT AND TRADEMARK OFFICE

CERTIFICATE OF CORRECTION

PATENT NO. : 4,027,219

DATED : May 31, 1977

INVENTOR(S) : WILLEM JEIJNDERT VAN ALPHEN ET AL

It is certified that error appears in the above-identified patent and that said Letters Patent are hereby corrected as shown below:

Column 3, line 4 of "TABLE I", "$-\frac{1}{1}N$" should be --$-\frac{1}{2}N$--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*